US009988321B2

(12) United States Patent
Fujisaki et al.

(10) Patent No.: US 9,988,321 B2
(45) Date of Patent: Jun. 5, 2018

(54) GAS GENERATING COMPOSITION

(71) Applicant: DAICEL CORPORATION, Osaka-shi, Osaka (JP)

(72) Inventors: Yoji Fujisaki, Tatsuno (JP); Naoki Matsuda, Tatsuno (JP)

(73) Assignee: DAICEL CORPORATION, Osaka-Shi (JP)

( * ) Notice: Subject to any disclaimer, the term of this patent is extended or adjusted under 35 U.S.C. 154(b) by 327 days.

(21) Appl. No.: 14/433,119

(22) PCT Filed: Sep. 20, 2013

(86) PCT No.: PCT/JP2013/075410

§ 371 (c)(1),
(2) Date: Apr. 2, 2015

(87) PCT Pub. No.: WO2014/061398

PCT Pub. Date: Apr. 24, 2014

(65) Prior Publication Data

US 2015/0239792 A1 Aug. 27, 2015

(30) Foreign Application Priority Data

Oct. 18, 2012 (JP) ..... 2012-230686

(51) Int. Cl.
*C06B 31/00* (2006.01)
*C06B 43/00* (2006.01)
*C06D 5/06* (2006.01)

(52) U.S. Cl.
CPC ..... *C06B 31/00* (2013.01); *C06B 43/00* (2013.01); *C06D 5/06* (2013.01)

(58) Field of Classification Search
CPC ..... C06B 43/00; C06B 31/00; C06B 5/06
See application file for complete search history.

(56) References Cited

U.S. PATENT DOCUMENTS 6,234,521 B1 5/2001 Katsuda et al.
6,527,886 B1 3/2003 Yamato et al.
(Continued)

FOREIGN PATENT DOCUMENTS

CN 1556782 A 12/2004
CN 101990526 A 3/2011
(Continued)

OTHER PUBLICATIONS

English translation of International Preliminary Report on Patentability and Written Opinion dated Apr. 30, 2015, in PCT International Application No. PCT/JP2013/075410.
(Continued)

*Primary Examiner* — Aileen B Felton
(74) *Attorney, Agent, or Firm* — Birch, Stewart, Kolasch & Birch, LLP

(57) ABSTRACT

Provided is a gas generating composition which can maintain stable combustion performance even under variation of ambient temperature. The gas generating composition includes (a) a fuel and (b) an oxidizing agent and meets the following requirements (I) and (II):

(I) a combustion temperature at a time of ignition and combustion at any ambient temperature within a range of −40° C. to 85° C. is a melting point of a substance included in a combustion residue; and (II) a difference between combustion temperatures at the time of ignition and combustion at ambient temperatures of −40° C. and 85° C. is less than 125 K.

12 Claims, 1 Drawing Sheet

(56) References Cited

U.S. PATENT DOCUMENTS

| | | | | |
|---|---|---|---|---|
| 6,779,464 | B1 | 8/2004 | Yamato | |
| 2004/0123925 | A1 | 7/2004 | Wu | |
| 2006/0048871 | A1 | 3/2006 | Kawakami et al. | |
| 2008/0105342 | A1 | 5/2008 | Wu et al. | |
| 2008/0149233 | A1* | 6/2008 | Kobayashi | C06D 5/06 149/109.2 |
| 2011/0030858 | A1 | 2/2011 | Wu et al. | |
| 2012/0055593 | A1 | 3/2012 | Kobayashi | |
| 2013/0319586 | A1 | 12/2013 | Kobayashi | |
| 2013/0340900 | A1 | 12/2013 | Kobayashi et al. | |

FOREIGN PATENT DOCUMENTS

| | | | |
|---|---|---|---|
| JP | 8-175312 | A | 7/1996 |
| JP | 10-181516 | A | 7/1998 |
| JP | 2989788 | B2 | 12/1999 |
| JP | 2001-226188 | A | 8/2001 |
| JP | 3476771 | B2 | 12/2003 |
| JP | 4498927 | B2 | 7/2010 |
| JP | 2010-269969 | A | 12/2010 |
| WO | WO 2004/04829 | A1 | 6/2004 |
| WO | WO 2012/128302 | A1 | 9/2012 |
| WO | WO 2012/133072 | A1 | 10/2012 |

OTHER PUBLICATIONS

International Search Report, issued in PCT/JP2013/075410, dated Nov. 26, 2013.
Written Opinion of the International Searching Authority, issued in PCT/JP2013/075410, dated Nov. 26, 2013.

* cited by examiner

GAS GENERATING COMPOSITION

TECHNICAL FIELD

The present invention relates to a gas generating composition that can be used in a gas generator for an airbag apparatus.

BACKGROUND ART

The output of a gas generator during actuation changes depending on the external ambient temperature during the actuation. Accordingly, stabilizing the generated output within the desirable range in the actuation period of time of the gas generator is an important task for gas generators for airbag apparatuses which are safety devices.

In JP-A No. H08-175312, an attempt is made to eliminate output fluctuations of a gas generator by providing a buffer chamber for absorbing pressure fluctuations occurring in a combustion chamber in the course of combustion inside the gas generator.

In JP-B No. 2989788 (JP-A No. H10-181516), the output of a gas generator is stabilized by associating the gas generation amount with the opening area of the gas discharge port of the gas generator.

JP-B No. 3476771 (JP-A No. 2001-226188) and JP-B No. 4498927 (WO-A No. 2004/048296) disclose inventions in which the generated pressure is stabilized by maintaining a constant amount of generated gas when a molded article of a gas generating composition is burned by optimizing the shape of the molded article of the gas generating composition.

SUMMARY OF THE INVENTION

For resolving the aforementioned problem, the present invention provides a gas generating composition including (a) a fuel and (b) an oxidizing agent, which meets the following requirements (I) and (II):

(I) a combustion temperature at a time of ignition and combustion at any ambient temperature within a range of −40° C. to 85° C. is a melting point of a substance included in a combustion residue; and (II) a difference between combustion temperatures at the time of ignition and combustion at ambient temperatures of −40° C. and 85° C. is less than 125 K.

The present invention also provides a gas generating composition that includes: (a) 15% by mass to 30% by mass of a fuel, including no metal with a melting point higher than the melting point of copper; and (b) 70% by mass to 85% by mass of an oxidizing agent including (b-1) basic copper nitrate and (b-2) basic copper carbonate, with (b-1) taking 60% by mass to 70% by mass and (b-2) taking 30% by mass to 40% by mass in the total amount of (b-1) and (b-2), that does not include a metal hydroxide, and that meets the following requirements (I) and (II):

(I) a combustion temperature at a time of ignition and combustion at any ambient temperature within a range of −40° C. to 85° C. is a melting point of copper (1358 K); and (II) a difference between combustion temperatures at the time of ignition and combustion at ambient temperatures of −40° C. and 85° C. is less than 125 K.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
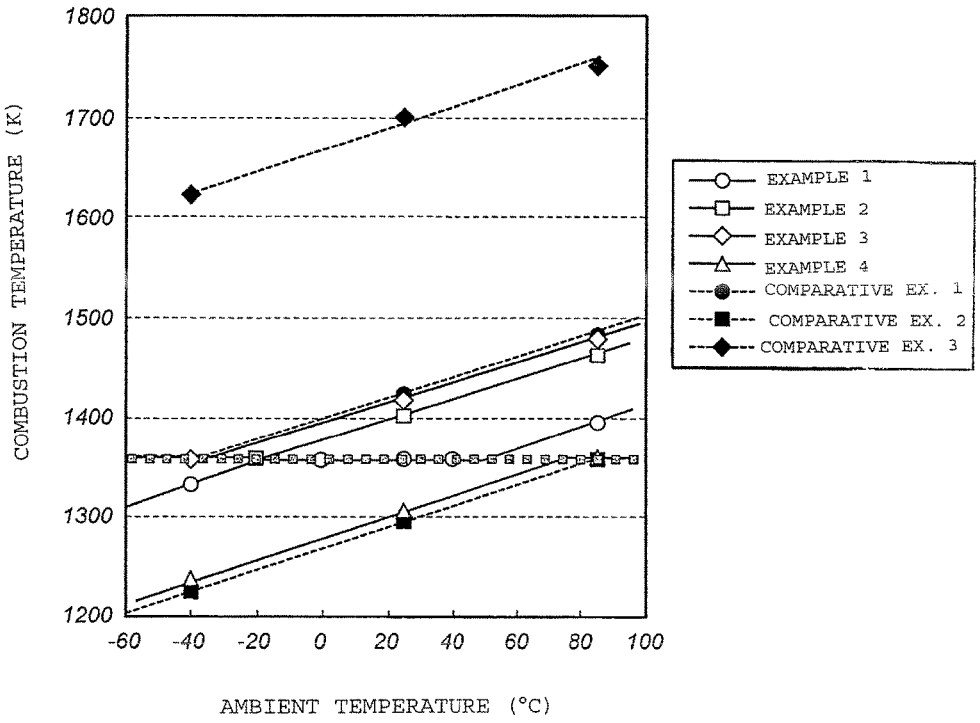
FIG. 1 illustrates the relationship between ambient temperature variations and combustion temperature variations in the gas generating compositions of the Examples and the Comparative Examples.

In JP-A No. H08-175312, the gas generator is unavoidably increased in size, and a requirement in recent years to miniaturize the gas generators is difficult to meet.

In JP-B No. 2989788, the output of the gas generator is not stabilized by actively controlling the performance of the gas generating agent itself.

In JP-B No. 3476771 and JP-B No. 4498927, where the temperature or pressure changes during combustion, the amount of the gas generated from the gas generating agent changes by itself. Therefore, further improvement is needed to obtain more stable output performance.

The present invention is to provide a gas generating composition that can maintain stable combustion performance regardless of fluctuations in the ambient temperature at the time of actuation and also can maintain a stable output when used in a gas generator.

The gas generating composition of the present invention can maintain stable combustion performance regardless of fluctuations in the ambient temperature at the time of actuation.

Embodiments of the Invention

<(a) Fuel>

One, or two or more listed hereinbelow can be used as a fuel included in the gas generating composition of the present invention:

guanidine nitrate, aminoguanidine nitrate, nitroguanidine, triaminoguanidine nitrate;

a triazine compound such as melamine, cyanuric acid, melamine cyanurate, ammeline, and ammelide;

a nitroamine compound such as trimethylene trinitroamine (RDX), cyclotetramethylene tetranitramine (HMX), azodicarbonamide (ADCA), and dicyandiamide (DCDA);

a tetrazole derivative such as 5-aminotetrazole (5-AT) and a 5-aminotetrazole metal salt; and a bitetrazole derivative such as bitetrazole, a bitetrazole metal salt, and bitetrazole ammonium salt.

It is further preferred that the fuel include no metal with a melting point higher than the melting point of copper, and the fuel is preferably a combination of one or more first fuel components selected from melamine and melamine cyanurate, and one or more second fuel components selected from nitroguanidine and 5-aminotetrazole.

Among them, the combination of melamine cyanurate and nitroguanidine is preferred since the heat generation amount can be reduced and a pressure index can be also reduced by a combination with an oxidizing agent.

<(b) Oxidizing Agent>

The oxidizing agent (b) preferably includes at least one selected from a basic metal nitrate, a basic carbonate, a nitrate, ammonium nitrate, a perchlorate, and a chlorate.

At least one selected from basic copper nitrate, basic cobalt nitrate, basic zinc nitrate, basic manganese nitrate, basic iron nitrate, basic molybdenum nitrate, basic bismuth nitrate, and basic cerium nitrate can be used as the basic metal nitrate.

At least one selected from basic cobalt carbonate, basic zinc carbonate, basic calcium carbonate, basic nickel carbonate, basic magnesium carbonate, and basic copper carbonate can be used as the basic carbonate.

An alkali metal nitrate such as potassium nitrate and sodium nitrate and an alkaline earth metal nitrate such as strontium nitrate can be used as the nitrate.

At least one selected from ammonium perchlorate, potassium perchlorate, sodium perchlorate, potassium chlorate, and sodium chlorate can be used as the perchlorate and chlorate.

Among them, the preferred oxidizing agent includes (b-1) basic copper nitrate and (b-2) basic copper carbonate.

The ratio of (b-1) and (b-2) is preferably such that (b-1) takes 60% by mass to 70% by mass and (b-2) takes 30% by mass to 40% by mass in the total amount thereof.

The ratio of the of the fuel which is the component (a) and the oxidizing agent which is the component (b) in the total amount thereof is such that the component (a) takes 15% by mass to 30% by mass, preferably 20% by mass to 25% by mass, and the component (b) takes 70% by mass to 85% by mass, preferably 75% by mass to 80% by mass.

The gas generating composition of the present invention may further include (c) a binder (not including a metal with a melting point higher than the melting point of copper) and/or (d) a combustion modifier (not including a metal with a melting point higher than the melting point of copper).

<(c) Binder>

The composition of the present invention can further include a binder. The binder does not include a metal with a melting point higher than the melting point of copper.

The binder can be one or two or more selected from carboxymethyl cellulose (CMC), carboxymethyl cellulose sodium salt (CMCNa), carboxymethyl cellulose potassium salt, carboxymethyl cellulose ammonium salt, cellulose acetate, cellulose acetate butyrate (CAB), methyl cellulose (MC), ethyl cellulose (EC), hydroxyethyl cellulose (HEC), ethyl hydroxyethyl cellulose (EHEC), hydroxypropyl cellulose (HPC), carboxymethyl ethyl cellulose (CMEC), microcrystalline cellulose, polyacryl amide, amino compounds of polyacrylamide, polyacryl hydrazide, a copolymer of acrylamide and a metal salt of acrylic acid, a copolymer of polyacrylamide and a polyacrylic acid ester compound, polyvinyl alcohol, acrylic rubber, guagum, starch, and silicones. Among these, carboxymethyl cellulose sodium salt (CMCNa) is preferred taking into account the binder adhesive properties, costs, ignitability and the like.

<(d) Combustion Modifier>

The composition of the present invention can also further include a combustion modifier within a range in which the problem of the present invention can be resolved. The combustion modifier does not include a metal with a melting point higher than the melting point of copper.

The combustion modifier can be at least one selected from metal oxides such as copper (II) oxide, iron oxide, zinc oxide, cobalt oxide, manganese oxide, molybdenum oxide, nickel oxide, bismuth oxide, silica, and alumina; metal hydroxides such as aluminum hydroxide, magnesium hydroxide, cobalt hydroxide, and iron hydroxide; cobalt carbonate, calcium carbonate; complex compounds of metal oxides or hydroxides such as Japanese acid clay, kaolin, talc, bentonite, diatomaceous earth, and hydrotalcite; metal acid salts such as sodium silicate, mica molybdate, cobalt molybdate, and ammonium molybdate; silicones, molybdenum disulfide, calcium stearate, silicon nitride, silicon carbide, metaboric acid, boric acid, and anhydrous boric acid.

The composition of the present invention includes the fuel which is the component (a) and the oxidizing agent which is the component (b), and also meets the following requirements (I) and (II).

The ambient temperature is a temperature when a gas generator charged with the composition of the present invention is incorporated in an airbag apparatus mounted on a vehicle. For example, the ambient temperature in the summer is significantly different from that in the winter, and even in the same season, the ambient temperature differs significantly depending on whether the vehicle is parked in the sun or in the shade.

<Requirement (I)>

The requirement (I) is that a combustion temperature at a time of ignition and combustion at any ambient temperature within a range of −40° C. to 85° C. is within a range of ±10 K of the melting point (1358 K) of copper.

The requirement (I) is that the combustion temperature of the gas generating composition of the present invention at a specific temperature and within a specific temperature range at an ambient temperature within a range of −40° C. to 85° C. is within a range of ±10 K of the melting point (1358 K) of copper.

For example, when the gas generating composition is used in a gas generator for an airbag apparatus to be installed in an automobile with cold region specifications, the requirement (I) can be met at a low temperature or in a low temperature range. Conversely, when the gas generating composition is used in a gas generator for an airbag apparatus to be installed in an automobile with tropical region specifications, the requirement (I) can be met at a high temperature or in a high temperature range.

<Requirement (II)>

The requirement (II) is that a difference between combustion temperatures at the time of ignition and combustion at ambient temperatures of −40° C. and 85° C. is less than 125 K.

In the requirement (II), the difference is preferably equal to or less than 122 K, more preferably, equal to or less than 110 K, and even more preferably equal to or less than 105 K.

Where the requirements (I) and (II) are met, even when the amount of heat inside the combustion system increases due to an abrupt rise in pressure in the combustion container (a housing of the gas generator) during combustion, this amount of heat is absorbed by the melting heat (latent heat) of the substance (for example, copper) included in the combustion residue and the temperature inside the combustion system does not rise, thereby enabling stable combustion.

The "combustion temperature", as referred to in the present invention, is determined by theoretical computations from the gas generating composition used.

The gas generating composition in accordance with the present invention can be molded to the desired shape, and can be in the form of a molded article of a single-perforated columnar shape, a perforated columnar shape, or a pellet. The molded article can be manufactured by adding water or an organic solvent to the gas generating composition, mixing and extrusion-molding (a molded article in the form of a cylinder having a single hole or a perforated cylinder), or by compression-molding with a pelletizer or the like (a molded article in the shape of a pellet).

The gas generating composition in accordance with the present invention and a molded article obtained therefrom can be used, for example, in an airbag inflator of a driver seat, an airbag inflator of a passenger seat next to the driver, a side airbag inflator, an inflator for an inflatable curtain, an inflator for a knee bolster, an inflator for an inflatable seat belt, an inflator for a tubular system, and an inflator for a pretensioner of various vehicles.

The inflator using the gas generating composition in accordance with the present invention or a molded article obtained therefrom may be of a pyrotechnic type in which a gas supplying source is only a gas generating agent and of a hybrid type which uses both a compressed gas such as argon and a gas generating agent.

The gas generating composition in accordance with the present invention or a molded article obtained therefrom can be also used as an igniting agent called an enhancer (or a booster) or the like, serving to transmit the energy of a detonator or a squib to the gas generating agent.

Examples

Example and Comparative Example

Gas generating compositions having the compositions shown in Table 1 were produced. The combustion temperature at the time when the ambient temperature has changed (requirement (I)) and the difference between combustion temperatures (requirement (II)) are shown in Table 1, and the combustion temperature at different ambient temperatures shown in Table 1 is depicted in a graphical form in FIG. 1.

TABLE 1

| | (a) | | | (b) | | (c) | | Combustion temperature at variations of ambient temperature (K) | | | | | | | | | Difference between combustion |
|---|---|---|---|---|---|---|---|---|---|---|---|---|---|---|---|---|---|
| | MC | NQ | GN | BCN | BCC | CMCNa | $Al(OH)_3$ | −40 | −20 | −10 | 0 | 25 | 40 | 50 | 60 | 85 | temperatures |
| Example 1 | 11.2 | 12.3 | | 46.5 | 25.0 | 5.0 | | 1332 | | 1358 | 1358 | 1358 | 1358 | | | 1395 | 63 |
| Example 2 | 9.7 | 15.1 | | 45.2 | 25.0 | 5.0 | | 1358 | 1358 | | | 1401 | | | | 1462 | 104 |
| Example 3 | 9.3 | 15.9 | | 44.8 | 25.0 | 5.0 | | 1358 | | | | 1418 | | | | 1479 | 121 |
| Example 4 | 13.3 | 8.3 | | 48.4 | 25.0 | 5.0 | | 1236 | | | | 1305 | | | | 1358 | 122 |
| Comparative Ex. 1 | 9.2 | 16.1 | | 44.7 | 25.0 | 5.0 | | 1358 | | | | 1423 | | | | 1483 | 125 |
| Comparative Ex. 2 | 13.5 | 8.0 | | 48.5 | 25.0 | 5.0 | | 1226 | | | | 1295 | | | | 1357 | 131 |
| Comparative Ex. 3 | | | 40.71 | 49.29 | | 5.00 | 5.00 | 1621 | | | | 1700 | | | | 1749 | 128 |

In the composition of Example 1, the combustion temperature within an ambient temperature range from 0° C. to 40° C. matches the melting point (1358 K) of copper (requirement (I)). For example, the combustion temperature at −40° C. in FIG. 1 is 1332° C., but the combustion temperature at −10° C., 0° C., 25° C., and 40° C. matches the melting point of copper.

In the composition of Example 2, the combustion temperature within an ambient temperature range from −40° C. to −20° C. matches the melting point (1358 K) of copper (requirement (I)).

In the composition of Example 3, the combustion temperature at −40° C. matches the melting point (1358 K) of copper (requirement (I)).

In the composition of Example 4, the combustion temperature at 85° C. matches the melting point (1358 K) of copper (requirement (I)).

Thus, in the compositions of Examples 1 to 4, the combustion temperature is not found to rise despite variations in the ambient temperature close to −10° C. to 40° C. (FIG. 1). As a result, the difference between the combustion temperature at the ambient temperature of 85° C. and the combustion temperature at the ambient temperature of −40° C. becomes equal to or less than 122 K (requirement (II)), and therefore stable ignition and combustion performance can be maintained regardless of the variations in the ambient temperature.

The composition of Comparative Example 1 is close to that of Example 3 and the requirement (I) is met, but the difference between the combustion temperature is 125 K, and the requirement (II) is not met.

The compositions of Comparative Examples 2 and 3 do not meet the requirements (I) and (II).

Therefore, in Comparative Examples 1 to 3, when the ambient temperature changes, stable ignition and combustion performance cannot be maintained.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A gas generating composition comprising (a) a fuel which is a combination of at least one first fuel component selected from the group consisting of melamine and melamine cyanurate and at least one second fuel component selected from the group consisting of nitroguanidine and 5-aminotetrazole and (b) an oxidizing agent including 60-70 mass-% of (b-1) basic copper nitrate and 30-40 mass-% of (b-2) basic copper carbonate, and (c) a binder, not including a metal with a melting point higher than the melting point of copper, the composition meeting the following requirements (I) and (II):

(I) a combustion temperature at a time of ignition and combustion at any ambient temperature within a range of −40° C. to 85° C. is within a range of ±10 K of the melting point of copper (1358K); and (II) a difference between combustion temperatures at the time of ignition and combustion at ambient temperatures of −40° C. and 85° C. is less than 125 K.

2. The gas generating composition according to claim 1, further comprising (c) a binder, not including a metal with a melting point higher than the melting point of copper, and/or (d) a combustion modifier, not including a metal with a melting point higher than the melting point of copper.

3. A gas generating composition that comprises:

(a) 15% by mass to 30% by mass of a fuel, including no metal with a melting point higher than the melting point of copper, wherein said fuel is a combination of at least one first fuel component selected from the group consisting of melamine and melamine cyanurate, and at least one second fuel component selected from the group consisting of nitroguanidine and 5-aminotetrazole; and (b) 70% by mass to 85% by mass of an oxidizing agent including (b-1) basic copper nitrate and (b-2) basic copper carbonate, with (b-1) taking 60% by mass to 70% by mass and (b-2) taking 30% by mass to 40% by mass in the total amount of (b-1) and (b-2), that does not comprise a metal hydroxide; and (c) a binder, not including a metal, with a melting point higher than the melting point of copper, and that meets the following requirements (I) and (II):

(I) a combustion temperature at a time of ignition and combustion at any ambient temperature within a range of −40° C. to 85° C. is within a range of ±10 K of the melting point of copper (1358 K); and (II) a difference between combustion temperatures at the time of ignition and combustion at ambient temperatures of −40° C. and 85° C. is less than 125 K.

4. The gas generating composition according to claim 3, further comprising (d) a combustion modifier, not including a metal with a melting point higher than the melting point of copper.

5. The gas generating composition according to claim 1, wherein the fuel, which is component (a), is a combination of melamine cyanurate and nitroguanidine.

6. The gas generating composition according to claim 5, wherein the oxidizing agent, which is component (b), is a combination of basic copper carbonate and basic copper nitrate.

7. The gas generating composition according to claim 6, further comprising (c) a binder of sodium carboxymethyl cellulose.

8. The gas generating composition according to claim 7, which does not include a combustion modifier.

9. The gas generating composition according to claim 3, wherein the fuel, which is component (a), is a combination of melamine cyanurate and nitroguanidine.

10. The gas generating composition according to claim 9, wherein the oxidizing agent is a combination of basic copper carbonate and basic copper nitrate.

11. The gas generating composition according to claim 10, further comprising a binder of sodium carboxymethyl cellulose.

12. The gas generating composition according to claim 11, which does not include a combustion modifier.

* * * * *